US006668474B2

(12) United States Patent
Winterton et al.

(10) Patent No.: US 6,668,474 B2
(45) Date of Patent: Dec. 30, 2003

(54) OUTDOOR SIGN APPARATUS FOR REAL ESTATE OR OTHER ADVERTISING PURPOSES

(76) Inventors: Dean Winterton, 1173 County Line Rd., Paw Paw, IL (US) 61353; Porter J. Martin, 8842 Indian Rd., Shabbona, IL (US) 60550

( * ) Notice: Subject to any disclaimer, the term of this patent is extended or adjusted under 35 U.S.C. 154(b) by 0 days.

(21) Appl. No.: 09/758,892

(22) Filed: Jan. 11, 2001

(65) Prior Publication Data

US 2002/0088157 A1 Jul. 11, 2002

(51) Int. Cl.[7] ..... G09F 15/00
(52) U.S. Cl. ..... 40/610; 40/607.1
(58) Field of Search ..... 40/610, 612, 606, 40/607, 601; 248/508, 167, 168, 188.6, 133

(56) References Cited

U.S. PATENT DOCUMENTS

| | | | | | |
|---|---|---|---|---|---|
| 2,474,920 | A | * | 7/1949 | Stearns | 248/508 |
| 3,557,479 | A | * | 1/1971 | Allison et al. | 40/610 |
| 3,591,116 | A | * | 7/1971 | Dalum | 40/610 X |
| 3,830,457 | A | * | 8/1974 | Stewart | 248/508 |
| 3,847,335 | A | | 11/1974 | Ross | |
| 3,928,930 | A | * | 12/1975 | Attwood | 40/607 |
| 4,092,792 | A | | 6/1978 | Vorhees | 40/607 |
| 4,259,803 | A | | 4/1981 | Sittler | 40/607 |
| 4,278,228 | A | * | 7/1981 | Rebentisch et al. | 40/612 X |
| 4,509,714 | A | | 4/1985 | Seely | |
| 4,516,344 | A | | 5/1985 | Seely | 40/602 |
| 4,660,310 | A | | 4/1987 | Farmer | 40/607 |
| 4,676,015 | A | | 6/1987 | Stoudt | 40/608 |
| 4,885,860 | A | | 12/1989 | Huenefeld | 40/606 |
| 4,916,840 | A | | 4/1990 | Getz | 40/605 |
| 4,923,157 | A | * | 5/1990 | Belamiza | 248/188.2 |
| 5,094,023 | A | * | 3/1992 | McVey | 40/606 |
| 5,667,175 | A | | 9/1997 | Brady | |
| 5,797,226 | A | * | 8/1998 | MacKarvich | 248/508 X |
| 5,878,518 | A | | 3/1999 | Grewe | 40/606 |
| 6,009,652 | A | | 1/2000 | Smith | 40/610 |

OTHER PUBLICATIONS

MDI International Headquarters web pages dated Jul. 7, 2000—5 pages.

* cited by examiner

*Primary Examiner*—Joanne Silbermann
(74) *Attorney, Agent, or Firm*—Leydig, Voit & Mayer, Ltd.

(57) ABSTRACT

A novel outdoor sign apparatus for mounting to a ground surface, e.g. a real estate sign. The outdoor sign apparatus comprises a pair of horizontally spaced footings for a support base, a movable support frame that holds the sign, a plurality of stakes for mounting, and support elements. The support frame is supported by each of the footings and has a first position substantially perpendicular to the footings for display and a second position substantially parallel to the footings for transport. Support elements such as chains (or other similar means such as cables, rigid bars, etc.) connect between the support frame and the footings to selectively hold the support frame vertically upright in the first position. The support elements can be disconnected to release and lower the support frame to the lowered position for transport. The stakes are driven downward into the ground at an outwardly extending angle relative to the vertically upright support frame and sign. To guide the stakes, each of the footings includes outwardly angled stake guides proximate opposite ends of each footing that slidably receive the stakes.

24 Claims, 6 Drawing Sheets

OUTDOOR SIGN APPARATUS FOR REAL ESTATE OR OTHER ADVERTISING PURPOSES

FIELD OF THE INVENTION

The present invention generally relates to signage and more particularly to outdoor signage that may be temporarily mounted to the ground such as real-estate signs.

BACKGROUND OF THE INVENTION

A common practice in the real estate industry is to mount real estate advertising signs in areas of high public visibility, such as near a road or in the front yard of the property being sold. Because property is bought and sold throughout the year, real estate agents and other such persons attempt to mount and remove such real estate signs at various times throughout the year. It is intended that the sign be temporarily mounted when installed and easy to remove shortly after the property is sold. There are currently a couple deficiencies existing in the industry. One deficiency is that small bushes, overgrown weeds or grass can quickly obstruct smaller real estate signs. Larger real estate signs with posts require a posthole digger with difficult, labor-intensive installation and removal. Post-hole installation is particularly difficult during the winter when the ground is frozen. Installation or removal is practically impossible during such frozen ground conditions. Proper mounting of such larger signs is necessary; otherwise a strong wind can wreak much havoc and damage or blow over the real estate sign. Another requirement of any real estate sign is that it is easy to manipulate and transport utilizing the real estate agent's vehicle. A further desirable feature is that the real estate sign can be mounted on a wide variety of ground surfaces including inclined surfaces such as in a roadside ditch or on the side of a hill while at the same time positioning the sign vertically for easy viewing.

SUMMARY OF THE INVENTION

In view of the foregoing, it is the principle aim of the present invention to provide a more practical large outdoor sign for temporary installation to a ground surface.

It is another object of the present invention to provide an outdoor sign that is easier to install in a reliable manner, particularly in winter and with frozen ground conditions.

It is another object of the present invention to provide an outdoor sign that is more wind resistant than other existing signs.

It is another object of the present invention to provide an outdoor sign that is easy to transport from place to place while at the same time achieving the foregoing aims and objectives.

It is another object of the present invention to provide an outdoor sign that is capable of supporting the sign at a proper vertical position while being mounted on an inclined ground surface and at the same time achieving the foregoing aims and objectives.

In accordance with these and other aims and objectives, the present invention is directed at a novel outdoor sign apparatus for mounting to a ground surface and displaying advertising signs. The outdoor sign apparatus comprises a pair of horizontally spaced footings, a movable support frame that holds the sign, a plurality of stakes, and support elements. The footings rest on the ground surface to provide a support base. The support frame is supported by each of the footings and has a first position substantially perpendicular to the footings for display and a second position substantially parallel to the footings for transport. Support elements (such as chains or other similar means such as cables, rigid bars, brackets, etc.) connect between the support frame and the footings to selectively hold the support frame vertically upright in the first position. The support elements may be selectively disconnected to release and lower the support frame to a second position substantially parallel with the footings.

In accordance with an aspect of the present invention, the footings are secured to the ground surface using stakes proximate each end of the footing that are driven downward into the ground at opposing angles relative to each other. Preferably each stake is driven at an outwardly extending angle relative to the vertically upright support frame and sign. With opposing angles between pairs of stakes, the stakes cooperate to secure the sign in a manner that resists wind in all directions. To guide the stakes, each of the footings includes outwardly angled stake guides proximate opposite ends of each footing that slidably receive the stakes.

It is a feature of the invention that the sign is adjustable to accommodate different ground inclinations and sign orientations. According to this feature, the legs or posts attached to each of the footings are independently expandable and retractable such that the footings can be placed at different elevations on the ground while maintaining the sign level. The legs or posts may also be secured at angled positions between the vertically upright and the lowered positions for compensating for the incline of the ground surface.

Other objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE PREFERRED EMBODIMENTS

For purposes of illustration, a preferred embodiment of the present invention has been illustrated as an outdoor sign apparatus 10. The sign apparatus 10 may have many uses but one exemplary use is in the real estate industry for advertising property that is for sale. The sign apparatus 10 may be temporarily mounted to a ground surface 12 (e.g. in the front yard of a residence), removed when desired and then reused at another site.

Figure 1:
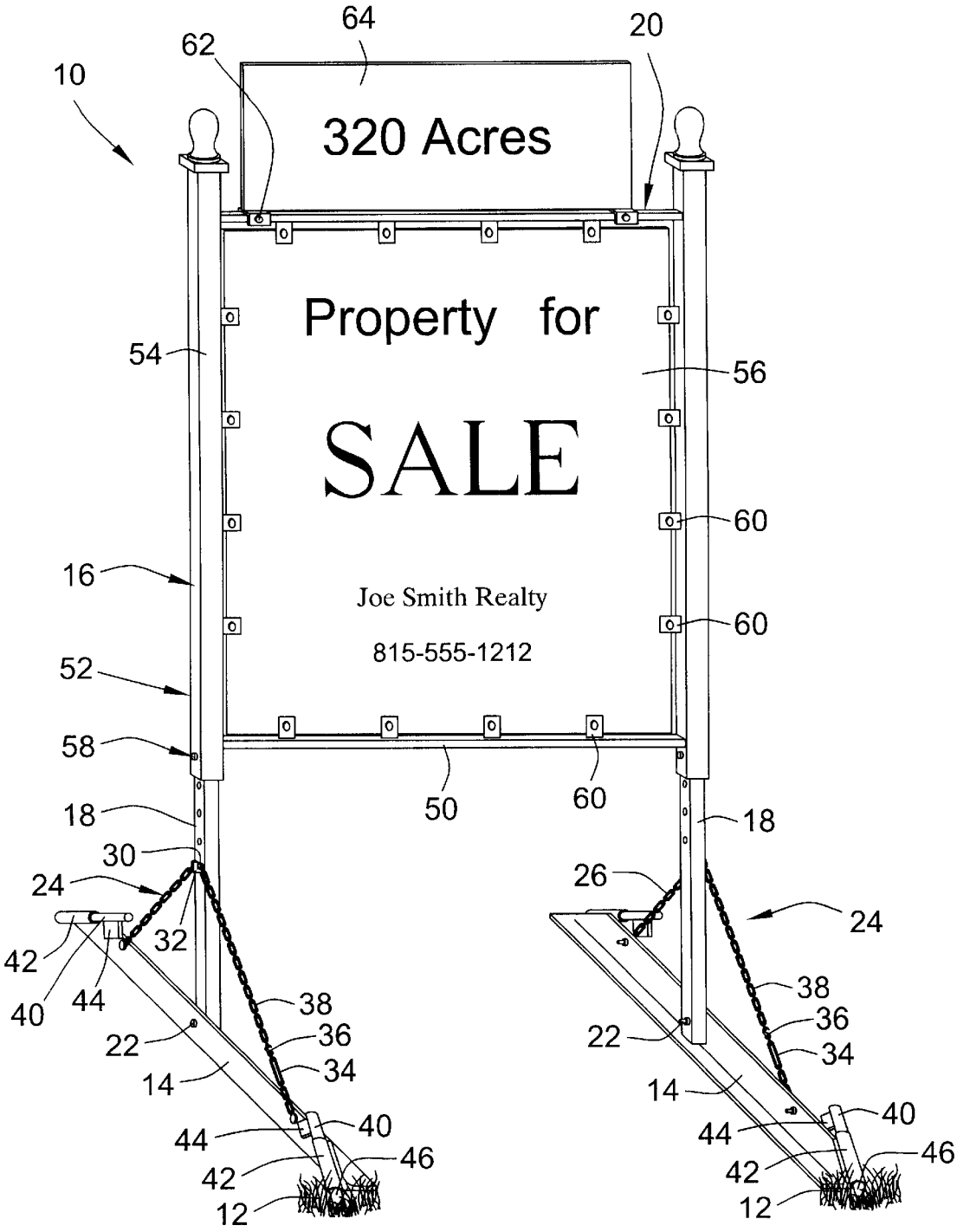
FIG. 1 is a perspective view of an outdoor sign apparatus in accordance with a first preferred embodiment of the present invention.
Figure 2:
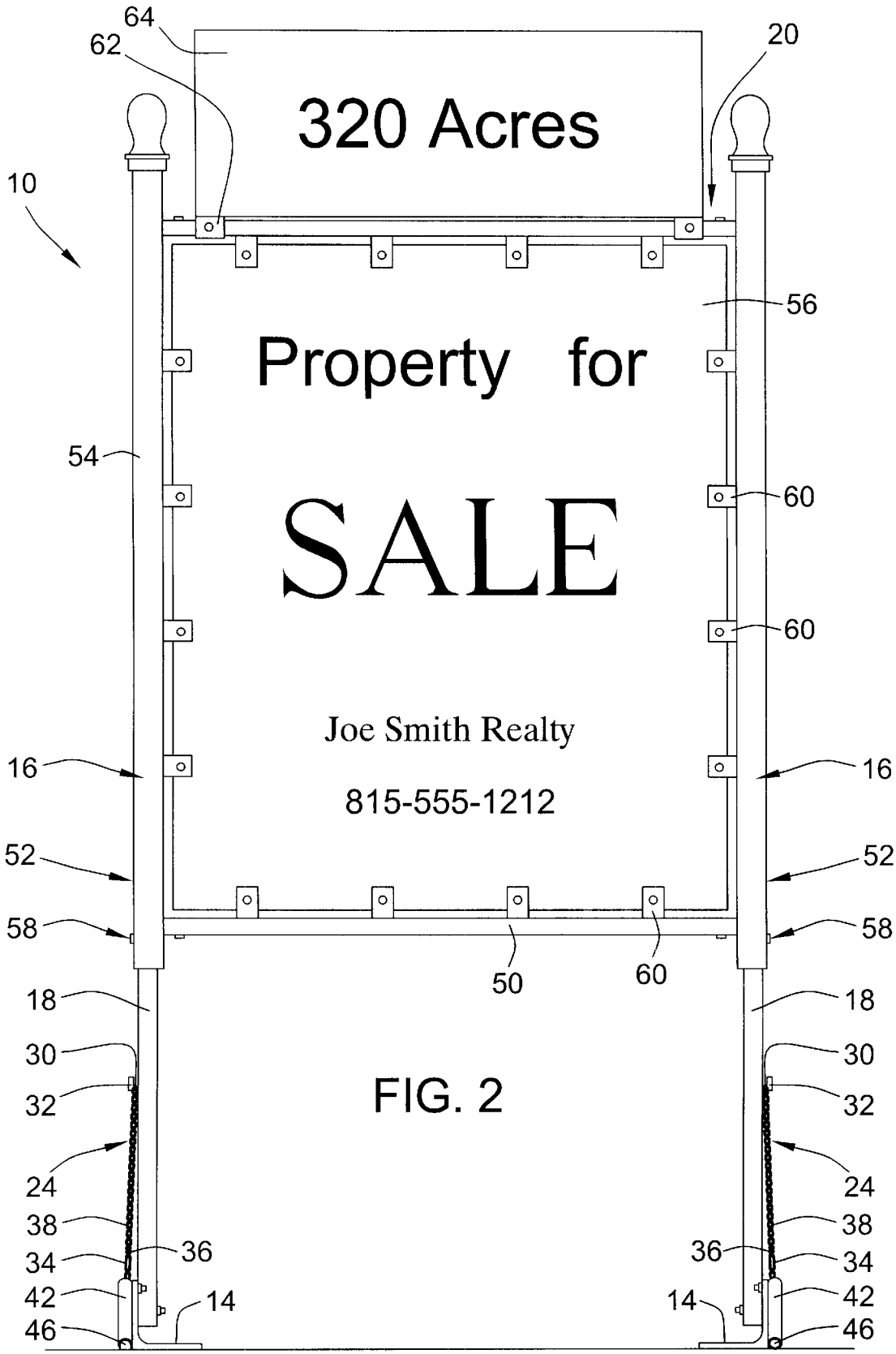
FIG. 2 is a front view of the outdoor sign apparatus shown in FIG. 1.
Figure 3:
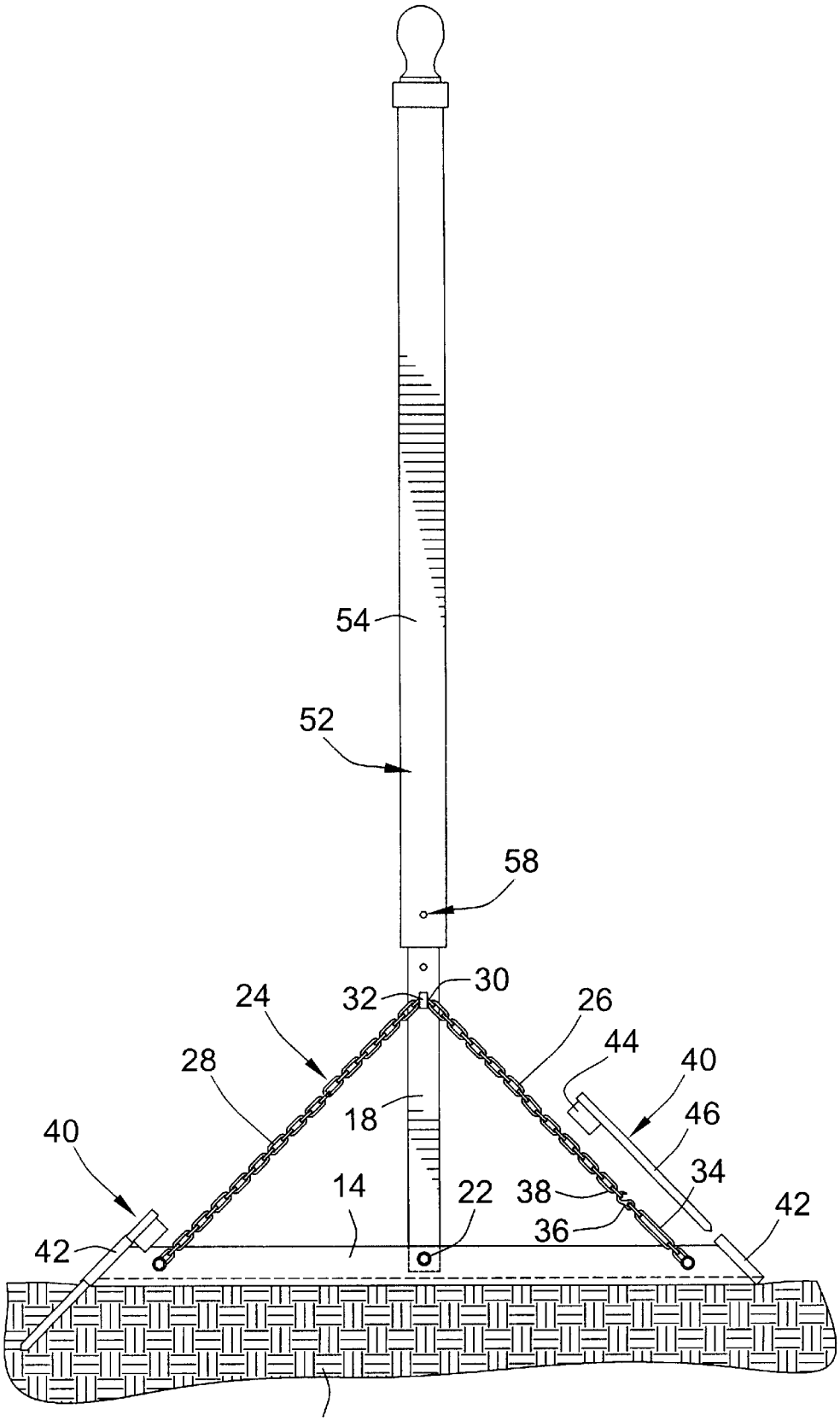
FIG. 3 is a side view of the outdoor sign apparatus shown in FIG. 1 in the vertically upright position for display.
Figure 4:
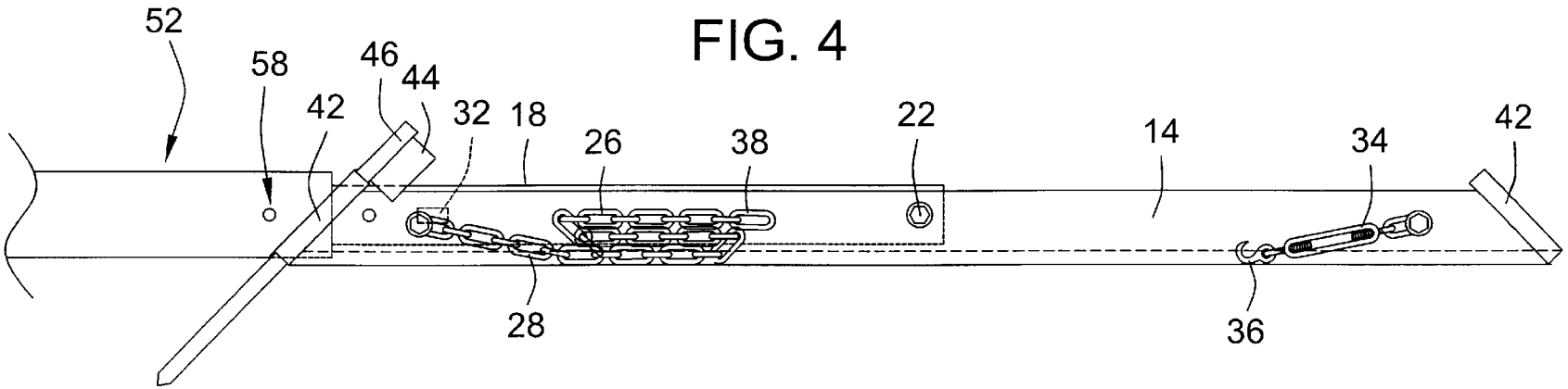
FIG. 4 is an enlarged, fragmented side view of the outdoor sign apparatus similar to that shown in FIG. 3 but in the lowered position for transport.
Figure 5:
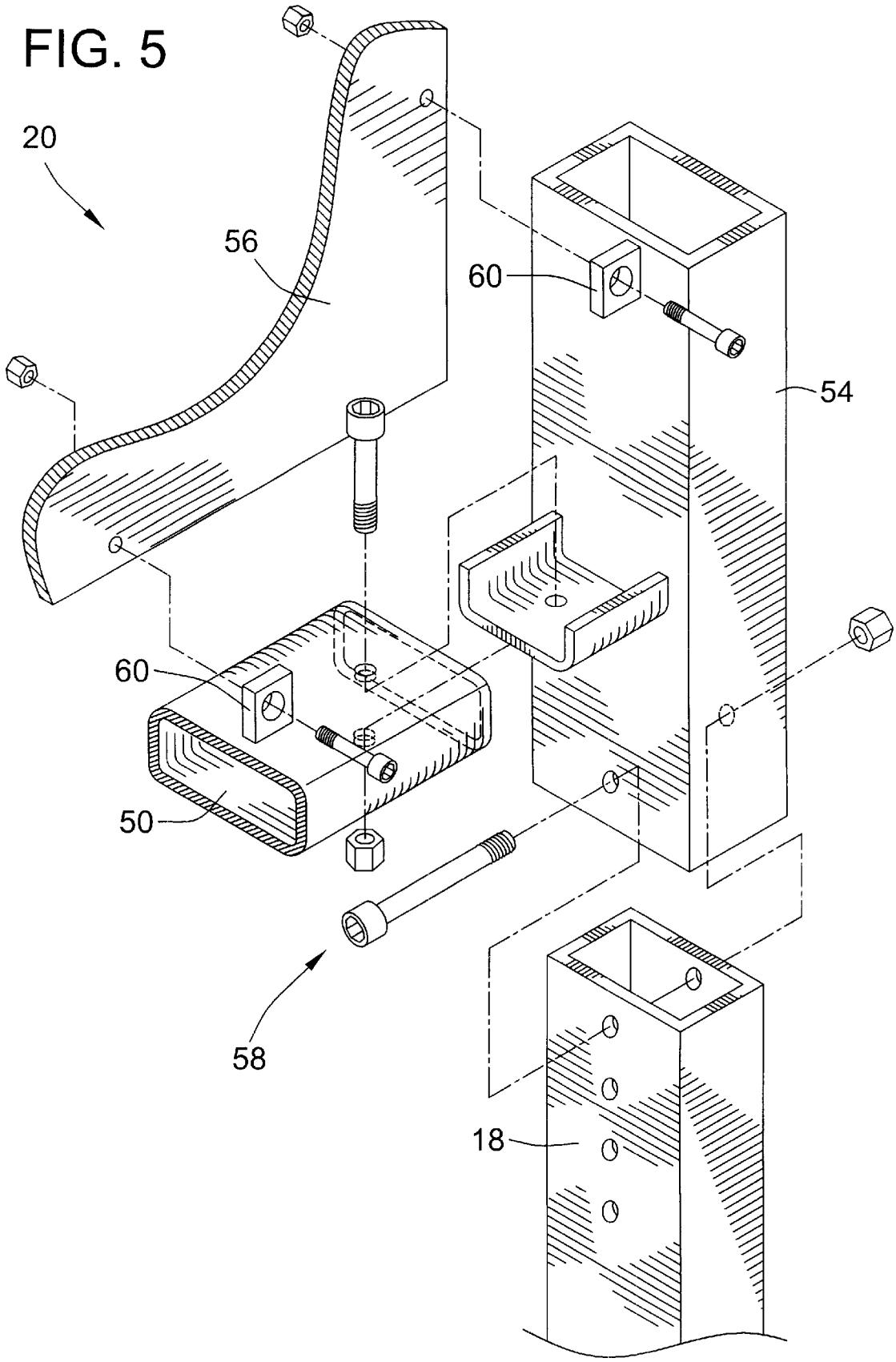
FIG. 5 is an enlarged exploded assembly view of the post and sign holder portion of the outdoor sign apparatus.

The sign apparatus 10 generally includes a pair of horizontally spaced footings 14 and a vertically upright support frame 16. The footings 14 are provided by angle iron in the preferred embodiment and rest horizontally upon the ground surface 12. The footings 14 are shown as independent of one another but may also be secured with one another with cross supports to provide an interconnected base structure. The support frame 16 generally includes a pair of vertical posts 18 that may be provided by square steel tube and a rectangular sign holder 20 mounted to the posts 18. Each post 18 is connected to and supported by one of the footings 14 through a pivot joint 22 provided by such means as a shoulder bolt, pin or hinge. Through the provision of the pivot joint 22, the support frame 16 is adapted to be pivoted between a vertically upright position as illustrated in FIGS. 1–3 and a lowered transport position as illustrated in FIG. 4. In the lowered transport position several sign holders may be stacked and the sign holder apparatus fits easily in a wide variety of vehicles typically driven by real estate agents.

To prevent the upright support frame 16 from collapsing when in the upright position, the sign apparatus 10 includes support elements in the form of two chains 24, one for each footing and post. Each chain 24 is divided into two segments 26, 28 that provide counteracting force relative to the other through tension. In particular, the ends of the chain 24 are secured to opposing ends of each footing 14. The middle link 30 of the chain 24 is secured in a narrow bracket 32 mounted on the post. The narrow bracket 32 has a width and length closely corresponding to the width of one link 30 such that when the middle link 30 is inserted into the bracket 32 little or no slippage is permitted which retains the posts 18 and therefore the entire sign support frame 16 in the vertically upright position. Although chains are shown in the first embodiment, it will be appreciated that other support elements could be substituted for the purpose such as rigid bars or cables for example. Each long chain may also be broken into two separate chain segments that may be fastened or welded to the support post.

In accordance with the adjustment feature of the invention, other chain links beside the middle link 30 may be secured in the bracket 32 to selectively angle the posts 18 and therefore the entire support frame 16 at an selected angle between the vertically upright and lowered positions that correlates to the inclination of the ground surface to keep the sign vertically upright despite an inclined ground surface.

In the illustrated embodiment, a tension control device 34 is incorporated into each chain 24. The tension control device 34 provides for adjustment and fine-tuning of the tension in the chain 24 to remove slack in the chain 24 and therefore remove slop in the support frame 16. The tension control device 34 is a commercial available device that includes a screw that can be used for selectively lengthening or shortening the chain 24. The tension control device 34 can be utilized to maintain proper chain tension when the sign holder is situated in angled positions between the vertically upright and perpendicular position and the lowered transport position.

It is an aspect of the present invention that the support frame 16 can be pivoted to the lowered position as shown in FIG. 4 such that the support frame 16 lies substantially parallel and generally flat with the footings 14 to provide for easy handling and transport of the sign apparatus 10. To accomplish this pivoting movement, the chains 24 (or one of the chain segments 26, 28) are released from either the post 18 or the footings 14 or both. In the illustrated embodiment, the chains 24 are released via an open hook 36 at the end of each tension control device 34. The end chain link 38 may be selectively connected and disconnected to the hook 36. Once disconnected, the sign apparatus 10 easily collapses to the lowered position for transport.

The footings 14 can be temporarily but securely secured to the ground surface 12 with stakes 40. Two stakes 40 are provided for each footing 14, with one stake 40 securing each opposed end of the footing 14 to the ground surface 12. To ensure that the wind does not blow the sign apparatus 10 over, the two stakes 40 for each footing 14 are driven into the ground surface 12 in opposite directions (both being driven either outwardly or inwardly towards the central mounted support frame 16). A hammer and preferably a sledgehammer can be used to drive the stakes 40. It has been found that such steel stakes drive relatively easily into frozen ground which permits winter installation and removal. To guide and ensure a proper angle and opposite angle directions for cooperating pairs of stakes 40, end tubes or stake guides 42 are welded proximate each opposed end of each footing 14. In the illustrated embodiment, the stake guides 42 angle outwardly away from the support frame 16, preferably between an angle of about 30 and about 60 relative to horizontal to provide optimal wind resistance. Each stakes 40 includes a stop tab 44 welded to the end of a steel rod 46. The steel rod 46 is sized closely in diameter to the inner diameter of the stake guide 42 to ensure proper support but yet to allow easy sliding movement at the proper angle. The tab 44 projects radially outward from the rod end to a diameter larger than the inner diameter of the tube of the stake guide 42 to act as stop and secure the stake guide 42 and therefore the footing 14 securely against the ground surface 12. The tab 44 also provides a structure that can be used to pull the stake 40 from the ground when removing a sign apparatus 10.

The sign apparatus 10 also has a vertical adjustment feature as can be seen in FIG. 1. Referring to FIG. 1, the rectangular sign holder 20 includes horizontal support members 50 and vertical support members 52 in the form of hollow square tubes 52 (e.g. cut from square tube steel). The rectangular sign holder 20 is the structure that directly secures and supports the sign 56, in this case a real estate sign 56 for advertising a piece of property for sale. The square tubes 52 slid over and closely interfit with the posts 18 extending vertically upward from the footings 14. To control the vertical height of the sign 56, the rectangular sign holder 20 may be raised or lowered to the desired position and then secured in position via a nut and bolt or pin and hole mechanism 58 as illustrated or other release mechanism such as a clamp. It is a feature that each of the vertical supports (comprising the combination of the vertical support members 52 and posts) is also independently expandable and retractable such that the footings 14 may be positioned at different elevations. This feature is useful for mounting the sign apparatus 10 in a ditch, in which the different footing elevations would keep the sign level.

The sign apparatus 10 further includes a sign interchangeability feature for removing and replacing the sign 56. For this feature, the rectangular sign holder 20 includes sign mounts or brackets 60 about the inside rectangular periphery of the sign holder 20. Signs 56 can be selectively bolted to the brackets 60 and later removed, if desired, from the sign holder 20.

A further optional feature is the provision of a top bracket 62 that mounts on the top of the rectangular sign holder 20 for holding a second smaller sign 64 for such purposes in exemplary real estate applications as indicating such things as acreage or other special feature of the property or that the property has already been sold.

Figure 6:
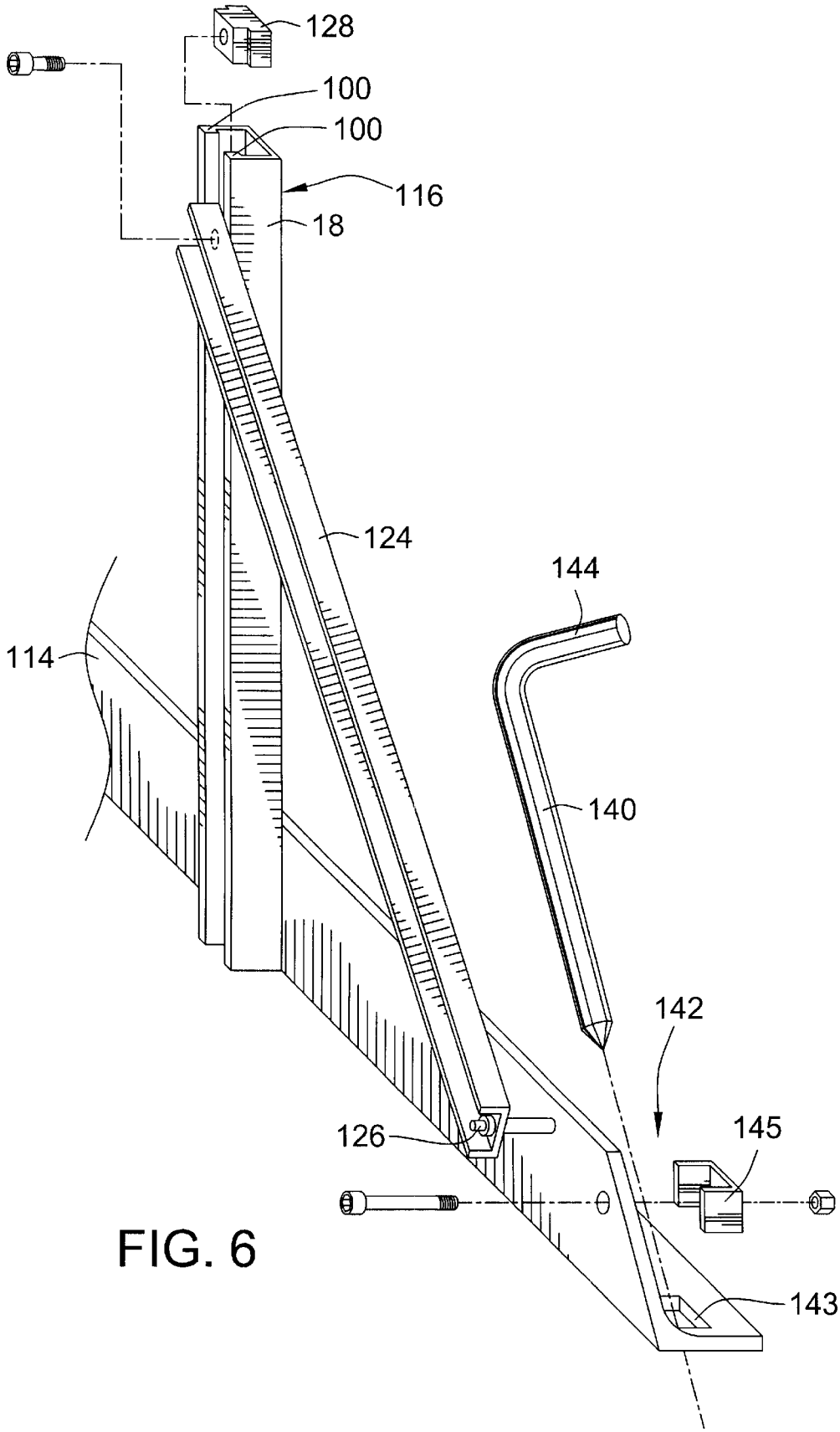
FIG. 6 is an enlarged, fragmented perspective view of the lower portion of an outdoor sign apparatus to illustrate a second preferred embodiment of the present invention.

Turning to FIG. 6, a second preferred embodiment is illustrated. The second embodiment illustrates an alternative way to secure the sign support frame 116 in the vertical position and also a simpler less expensive design for the stakes and the metal support tubes or stake guides as compared with the first embodiment. Several of the welding and assembly steps have been eliminated with this design. In this second embodiment of FIG. 6, the vertical posts 118 of the support frame 116 are also pivotably mounted near the center of the footing 114. However, the vertical posts 118 are metal c-channels with internal edges or lips 100. The chains have been eliminated as the support elements and replaced with a diagonal bar or brace 124 (preferably one for each footing) as the support element. Each brace 124 has one end pivotably connected and the other end clamped or otherwise connected in a releasable manner for selective disconnection. In this embodiment the brace 124 is pivotably connected to the footing 114 through a pivot joint 126 and releasably clamped to the c-channel of the vertical posts 118 via a square clamp 128 inserted into the c-channel. The clamp 128 grips the lips 100 of the c-channel to secure the support frame 116 in either the vertically upright or lowered position as desired. In the second embodiment, the stakes 140 are also different with one end bent or deformed to provide the stop tabs 144. The stakes 140 are also guided by a different form of stake guide 142 which comprises a hole 143 torched or otherwise formed in the bottom of the footing 114 in combination with a bracket 145 mounted to the footing in diagonal relationship thereto, both having diameters relatively closely conforming to those of the stakes 140. The bracket 145 is pivotably mounted and also allows for storage of stakes while the sign is not in use.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. An outdoor sign apparatus for mounting to a ground surface and displaying advertising, comprising:

a pair of horizontally spaced footings adapted to rest on a ground surface;

a support frame holding a sign for advertising, the support frame being supported by each of the footings, the support frame being movable relative to the footings between a vertically upright position substantially perpendicular to the footings for display of the sign and a lowered position substantially parallel to the footings for transport;

a plurality of stakes movable relative to the footings and engaging the footings, the stakes adapted to secure the footing to the ground surface;

at least one support element connected between the support frame and at least one of the footings to hold the support frame in the vertically upright position, the support frame being movable to the lowered position by disconnecting the at least one support element; and wherein the support frame is connected to each of the footings through a pivot joint for pivoting movement of the support frame, the support frame movable to a plurality of angled positions between the vertically upright position and lowered position and being selectively fixed in the angled positions by the at least one support element, the angled positions adapted to correct for inclined ground surfaces.

2. The outdoor sign apparatus of claim 1 wherein further comprising a pair of stake guides for each footing, one stake guide proximate each end of the footing slidably receiving a stake, the support frame being supported in the upright position between the stake guides of each footing.

3. The outdoor sign apparatus of claim 2 wherein the stake guides for each footing angle in opposite directions relative to each other.

4. The outdoor sign apparatus of claim 3 wherein each of the stake guides angles outwardly away from the support frame as each stake guide extends vertically downwardly to guide the stake at a predetermined angle and to direct the stakes an angle of between about 30 degrees and about 60 degrees relative to the plane of the footings.

5. The outdoor sign apparatus of claim 2 wherein each stake comprises an elongate steel rod and a stop tab at one end adapted to engage one of the stake guides for stopping penetration of stakes into the ground surface.

6. The outdoor sign apparatus of claim 1 wherein the support elements comprise chain segments, each chain segment having one end supporting the support frame and another end connected to one of the footings, the chains being respectively connected to the footing on opposite sides of the support frame such that the chain segments cooperate to hold the support frame in the vertically upright position, and wherein at least one chain segments is disconnectable from at least one of the support frame and the footing to allow movement of the support frame to the lowered position.

7. The outdoor sign apparatus of claim 1 wherein the support frame comprises a pair of spaced apart vertical support posts, each support post being pivotably mounted to one of the footings and a rectangular sign holder slidably mounted on the posts, the footings being independent of one another such that footings are positioned at different elevations when mounted on an inclined ground surface to keep the sign holder level.

8. The outdoor sign apparatus of claim 7 wherein the rectangular sign holder further comprises mounts for releasably holding the sign further comprising a sign bracket releasably mounted to a top side of the rectangular sign holder, the sign bracket having a second sign mounted therein.

9. The outdoor sign apparatus of claim 1 wherein the at least one support element is a brace connected diagonally between one of the footings and the support frame to support the support frame in the vertically upright position.

10. The outdoor sign apparatus of claim 9 wherein brace is pivotably connected to one of the support frame and the footing and clamped to the other one of the support frame and the footing, wherein the clamp can be unclamped to release the brace and pivot the support frame between vertically upright and lowered positions.

11. An outdoor sign apparatus for mounting to a ground surface and displaying advertising, comprising:

a pair of horizontally spaced footings extending between opposed ends, adapted to rest on a ground surface;

a support frame holding a sign for advertising, the support frame being supported in a vertically upright position by each of the footings substantially perpendicular thereto and between the opposed ends for display of the sign;

a plurality of stake guides secured to the footings, one stake guide proximate each of the opposed ends of each footing, the stake guides for each footing angling in opposite directions relative to each other;

a plurality of stakes slidably inserted into the stake guides, the stakes adapted to secure the footings to the ground surface;

wherein the support frame is pivotably mounted to each of the footings, being pivotable from the upright position to a lowered position substantially parallel to the footings, further comprising support elements supported by the footings and support supporting the support frame to prevent pivoting of the support frame to the lowered position; and wherein the support frame is movable to a plurality of angled positions between the vertically upright position and lowered position and being selectively fixed in the angled positions by the support elements, the angled positions adapted to correct for inclined ground surfaces.

12. The outdoor sign apparatus of claim 11 wherein the support frame is movable relative to the footings from the vertically upright position to a lowered position substantially parallel to the footings for transport.

13. The outdoor sign apparatus of claim 11 wherein each stake comprises an elongate steel rod and a stop tab at one end.

14. The outdoor sign apparatus of claim 11 wherein the support frame is pivotably mounted to each of the footings, being pivotable from the upright position to a lowered position substantially parallel to the footings, further comprising support elements supported by the footings and supporting the support frame to prevent pivoting of the support frame to the lowered position.

15. The outdoor sign apparatus of claim 11 further wherein the support elements comprise braces, each brace connected diagonally between one of the footings and the support frame, wherein each brace is pivotably connected to one of the support frame and the footing and releasably secured to the other one of the support frame and the footing.

16. The outdoor sign apparatus of claim 11 wherein the support frame comprises a pair of spaced apart vertical support posts, each support post being pivotably mounted to one of the footings and a rectangular sign holder slidably mounted on the posts, the footings being independent of one another such that footings are positioned at different elevations when mounted on an inclined ground surface to keep the sign holder level.

17. The outdoor sign apparatus of claim 11 wherein the rectangular sign holder further comprises mounts for releasably holding the sign further comprising a sign bracket releasably mounted to a top side of the rectangular sign holder, the sign bracket having a second sign mounted therein.

18. The outdoor sign apparatus of claim 11 wherein each of the stake guides angle outwardly away from the support frame as each stake guide extends vertically downwardly.

19. An outdoor sign apparatus for mounting to a ground surface and displaying advertising, comprising:

a pair of horizontally spaced footings extending between opposed ends, adapted to rest on a ground surface;

a support frame holding a sign for advertising, the support frame being pivotably connected to each of the footings for support thereby, the support frame being pivotable relative to the footings between a vertically upright position substantially perpendicular to the footings for display of the sign and a lowered position substantially parallel to the footings for transport;

a plurality of stakes adapted to secure the footings to the ground surface, each stake comprising an elongate penetration rod and a stop tab at one end;

support elements connected between the support frame and the footings to hold the support frame in the vertically upright position, the support frame being movable to the lower position by disconnecting support elements;

a plurality of stake guides secured to the footings, one stake guide proximate each of the opposed ends of each footing, the stake guides of each footing angling in opposite directions relative to each other, the stakes slidably inserted into the stake guides; and wherein the support frame is movable to a plurality of angled positions between the vertically upright position and lowered position and being selectively fixed in the angled positions by the support elements, the angled positions adapted to correct for inclined ground surfaces.

20. The outdoor sign apparatus of claim 19 wherein the support elements comprise chain segments, each chain segment having one end supporting the support frame and another end connected to one of the footings, the chains being respectively connected to the footing on opposite sides of the support frame such that the chain segments cooperate to hold the support frame in the vertically upright position, and wherein at least one chain segments is disconnectable from at least one of the support frame and the footing to allow pivoting movement of the support frame to the lowered position.

21. The outdoor sign apparatus of claim 19 wherein the support frame comprises a pair of spaced apart vertical support posts, each support post being pivotably mounted to one of the footings and a rectangular sign holder slidably mounted on the posts, the footings being independent of one another such that footings are positioned at different elevations when mounted on an inclined ground surface to keep the sign holder level.

22. The outdoor sign apparatus of claim 19 further comprising a sign bracket releasably mounted to a top side of the rectangular sign holder, the sign bracket having a second sign mounted therein.

23. The outdoor sign apparatus of claim 19 wherein the support elements are braces, each brace connected diagonally between one of the footings and the support frame to support the support frame in the vertically upright position.

24. The outdoor sign apparatus of claim 23 wherein brace is pivotably connected via a to one of the support frame and the footing and clamped to the other of the support frame and the footing, wherein the clamp can be unclamped to release the brace and pivot the support frame between vertically upright and lowered positions.

* * * * *